US008115576B2

(12) United States Patent
Lu et al.

(10) Patent No.: US 8,115,576 B2
(45) Date of Patent: Feb. 14, 2012

(54) MEMS ACTUATORS AND SWITCHES

(75) Inventors: Jun Lu, Lasalle (CA); Stephane Menard, Kirkland (CA)

(73) Assignee: Réseaux MEMS, Société en Commandite, Montreal, QC (CA)

( * ) Notice: Subject to any disclaimer, the term of this patent is extended or adjusted under 35 U.S.C. 154(b) by 659 days.

(21) Appl. No.: 11/308,358

(22) Filed: Mar. 18, 2006

(65) Prior Publication Data

US 2006/0238279 A1 Oct. 26, 2006

Related U.S. Application Data

(60) Provisional application No. 60/662,829, filed on Mar. 18, 2005.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 6,124,650 | A * | 9/2000 | Bishop et al. | 335/78 |
| 6,407,478 | B1 * | 6/2002 | Wood et al. | 310/307 |
| 6,433,657 | B1 | 8/2002 | Chen | |
| 7,548,145 | B2 * | 6/2009 | Rubel | 335/78 |
| 7,602,266 | B2 * | 10/2009 | Menard et al. | 335/78 |
| 7,724,121 | B2 * | 5/2010 | Rubel | 337/139 |
| 7,760,065 | B2 * | 7/2010 | Gasparyan et al. | 337/123 |
| 2003/0025580 | A1 * | 2/2003 | Wheeler et al. | 335/78 |
| 2005/0189204 | A1 * | 9/2005 | Yeatman et al. | 200/181 |
| 2007/0188846 | A1 * | 8/2007 | Slicker et al. | 359/290 |
| 2009/0085699 | A1 * | 4/2009 | Aksyuk et al. | 335/78 |

FOREIGN PATENT DOCUMENTS

EP 1426992 8/2002

* cited by examiner

*Primary Examiner* — Bernard Rojas

(74) *Attorney, Agent, or Firm* — Fasken Martineau DuMoulin LLP; Alexandre Abecassis

(57) ABSTRACT

MEMS structures employing movable conductive member and a number of current-carrying stationary contact terminals which advantageously permit higher current carrying capability that prior art devices in which currents flowed through movable conductive members. Current carrying capability in excess of 1.0 amp without the need for additional current limiting devices is realized thereby lowering overall system manufacturing costs for systems employing our structures.

15 Claims, 20 Drawing Sheets

MEMS ACTUATORS AND SWITCHES

CROSS REFERENCE TO RELATED APPLICATIONS

This application claims the benefit of U.S. Provisional Application No. 60/662,829 filed Mar. 18, 2005, which describes an improvement over U.S. patent application Ser. No. 10/782,708 filed Feb. 17, 2004 claiming the benefit of U.S. Provisional Application No. 60/464,423 filed Apr. 22, 2003, the entire file wrapper contents of which applications are herein incorporated by reference as though set forth at length.

FIELD OF THE INVENTION

This application relates generally to the field of microelectromechanical systems (MEMS) and in particular to improved MEMS devices that do not require additional current limiting devices.

BACKGROUND OF THE INVENTION

Microelectromechanical systems (MEMS) are small, movable, mechanical structures built using well-characterized, semi-conductor processes. Advantageously, MEMS can be provided as actuators, which have proven to be very useful in many applications.

Present-day MEMS actuators quite small, having a length of only a few hundred microns, and a width of only a few tens of microns. Such MEMS actuators are typically configured and disposed in a cantilever fashion. In other words, they have an end attached to a substrate and an opposite free end which is movable between at least two positions, one being a neutral position and the others being deflected positions.

Electrostatic, magnetic, piezo and thermal actuation mechanisms are among the most common actuation mechanisms employed MEMS. Of particular importance is the thermal actuation mechanism.

As is understood by those skilled in the art, the deflection of a thermal MEMS actuator results from a potential being applied between a pair of terminals, called "anchor pads", which potential causes a current flow elevating the temperature of the structure. This elevated temperature ultimately causes a part thereof to contract or elongate, depending on the material being used.

One possible use for MEMS actuators is to configure them as switches. These switches are made of at least one actuator. In the case of multiple actuators, they are typically operated in sequence so as to connect or release one of their parts to a similar part on the other. These actuators form a switch which can be selectively opened or closed using a control voltage applied between corresponding anchor pads on each actuator.

MEMS switches have many advantages. Among other things, they are very small and relatively inexpensive—depending on the configuration. Because they are extremely small, a very large number of MEMS switches can be provided on a single wafer.

Of further advantage, MEMS switches consume minimal electrical power and their response time(s) are extremely short. Impressively, a complete cycle of closing or opening a MEMS switch can be as short as a few milliseconds.

Although prior-art MEMS actuators and switches have proven to be satisfactory to some degree, there nevertheless remains a general need to further improve their performance, reliability and manufacturability. For instance, one factor which generally increases the overall costs of a system using MEMS switches is the inclusion of any additional protection that is oftentimes required in particular markets.

One such type of additional protection that raises the cost of a MEMS based system is a current limiter device. These current limiters are external devices that protect each MEMS switch from being damaged by a relatively large current peak occurring in one of the circuits. Such current peaks—while usually brief in length—can damage unprotected MEMS switches. Eliminating the need for numerous current limiters in MEMS based systems would significantly decrease the overall costs of these systems and represent a significant advance in the art.

SUMMARY OF THE INVENTION

We have developed improved MEMS structures employing movable conductive member and a number of current-carrying stationary contact terminals which advantageously permits higher current carrying capability that prior art devices in which currents flowed through movable conductive members. Advantageously, and in sharp contrast to the prior art, our inventive structures may carry currents in excess of 1.0 amp without the need for additional current limiting devices. Consequently, systems employing our inventive structures exhibit significantly lower overall system manufacturing costs.

BRIEF DESCRIPTION OF THE DRAWING

A more complete understanding of the present invention may be realized by reference to the accompanying drawing in which.

DETAILED DESCRIPTION

Figure 1:
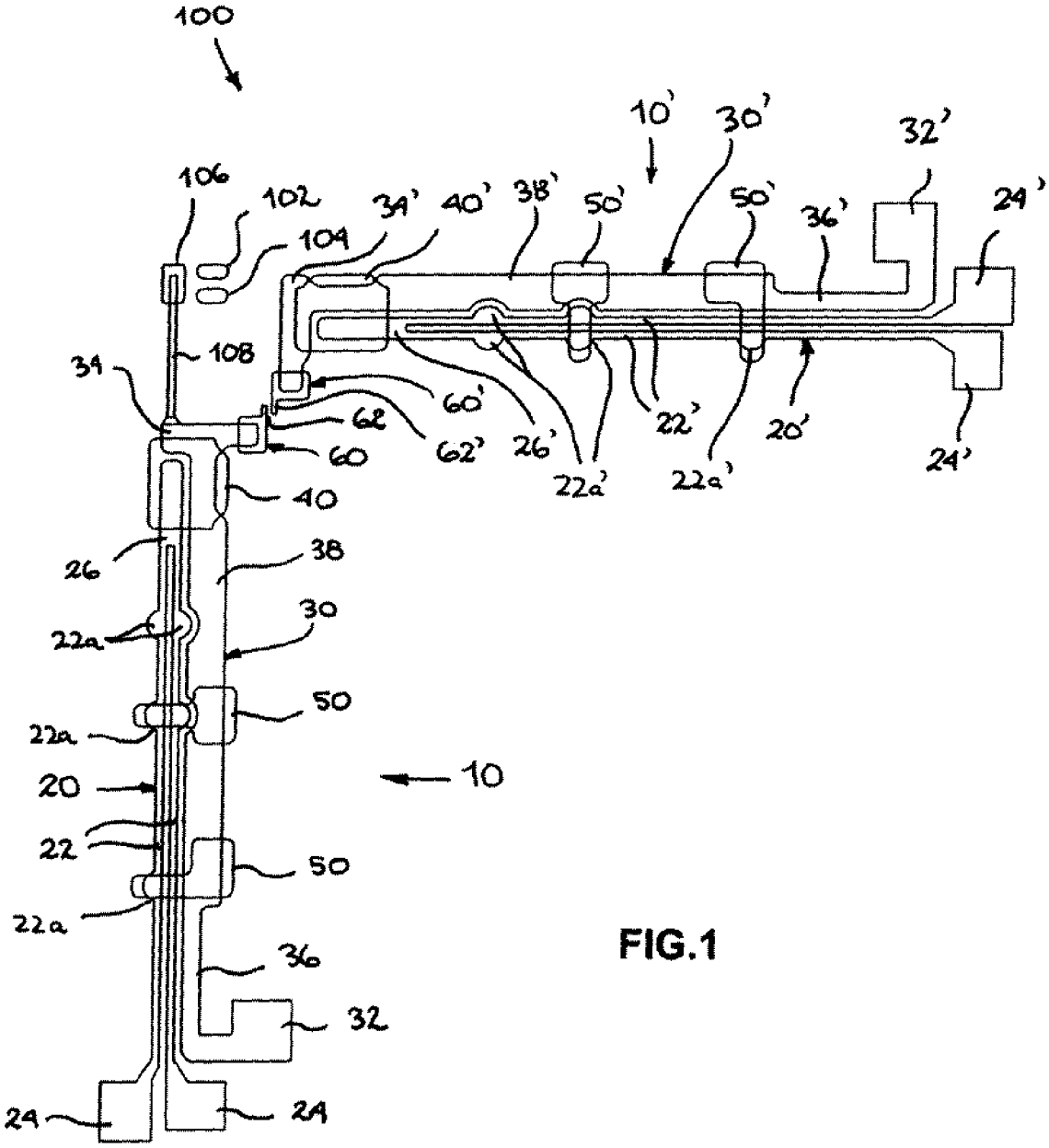
FIG. 1 is a schematic of an exemplary MEMS switch according to the present invention.

FIG. 1 shows an example of a MEMS switch (100) constructed according to the principles of the present invention. The switch (100) comprises two MEMS actuators (10, 10'). The MEMS switch (100) is used to selectively close or open a circuit between a pair of contact terminals (102, 104) using a movable conductive member (106) mounted at the end of a support arm (108).

When the MEMS switch (100) is in a closed position, the contact terminals (102, 104) are in electrical engagement—that is to say an electrical current may flow between the two contact terminals (102,104). This electrical engagement is realized when the movable conductive member (106) electrically "shorts" the pair of contact terminals (102,104).

Conversely, when the MEMS switch (100) is in an open position, the contact terminals (102, 104) are not electrically engaged and no appreciable electrical current flows between them. In preferred embodiments, the movable conductive member (106) is gold plated.

We have discovered that that using contact terminals (102, 104) such as those shown and a movable conductive member (106) allows the conducting of higher currents than MEMS devices in which an electrical conducting path goes along a length of the MEMS actuators (10, 10') themselves. Advantageously, and as a direct result of our inventive MEMS structure (100), it is now possible to employ MEMS switches while—at the same time—avoid using current limiters. As a result, overall manufacturing costs of systems employing MEMS switches may be significantly reduced.

Figure 2A:
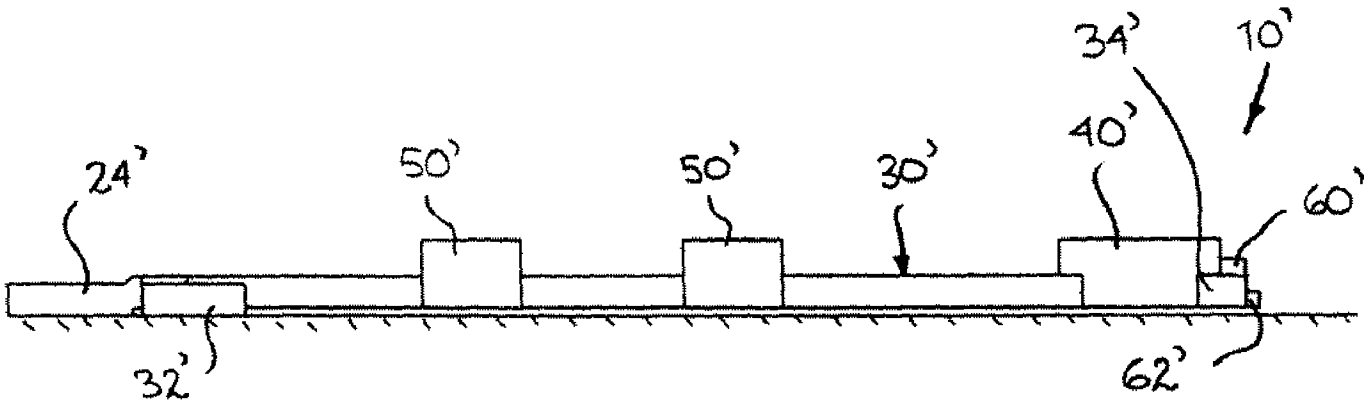
FIGS. 2*a* and 2*b* are side views of actuators employed by the MEMS switch of FIG. 1.
Figure 2B:
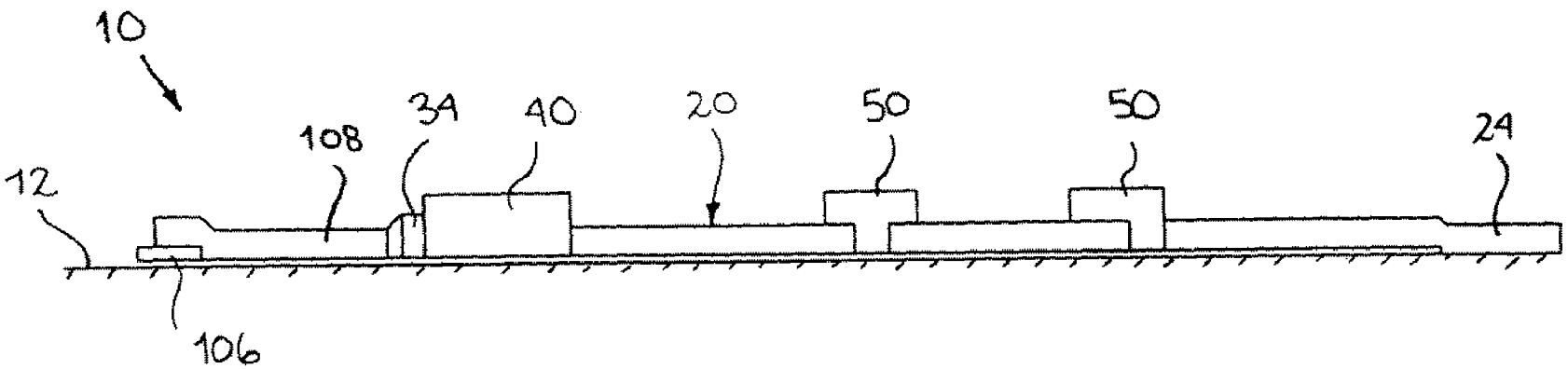

Turning our attention now to FIGS. 2*a* and 2*b*, there is shown side views of the actuators (10, 10') of FIG. 1 which are mounted on a substrate (12) in a cantilever fashion. One example of the substrate (12) is a silicon wafer—a very well characterized substrate. As can be readily appreciated by those skilled in the art however, our invention is not limited to silicon substrates.

Referring back to FIG. 1, each of the actuators (10, 10') comprises an elongated hot arm member (20, 20') having two spaced-apart portions (22, 22'). Each spaced-apart portion (22, 22') is provided at one end with a corresponding anchor pad (24, 24') connected to the substrate (12).

In each actuator (10, 10'), the spaced-apart portions (22, 22') are substantially parallel and connected together at a common end (26, 26') that is shown opposite the anchor pads (24, 24') and overlying the substrate (12).

Each of the actuators (10, 10') also comprises an elongated cold arm member (30, 30') adjacent and substantially parallel to the corresponding hot arm member (20, 20'). The cold arm member (30, 30') has, at one end, an anchor pad (32, 32') connected to the substrate (12) and a free end (34, 34') that is shown opposite the anchor pad thereof (32, 32'). The free end (34, 34') is overlying the substrate (12).

A dielectric tether (40, 40') is attached over the common end (26, 26') of the portions (22, 22') of the hot arm member (20, 20') and over the free end (34, 34') of the cold arm member (30, 30'). The dielectric tether (40, 40') is provided to mechanically couple the hot arm member (20, 20') and the cold arm member (30, 30') and to keep them electrically independent, thereby maintaining them in a spaced-apart relationship with a minimum spacing between them to avoid a direct contact or a short circuit in normal operation as well as to maintain the required withstand voltage, which voltage is proportional to the spacing between the corresponding members (20, 30 and 20', 30').

It should be noted that maximum used voltage can be increased by changing of the ambient atmosphere. For instance, the use of high electro-negative gases as ambient atmosphere would increase the withstand voltage. One example of this type of gases is Sulfur Hexafluoride, $SF_6$.

The dielectric tether (40, 40') is preferably molded directly in place at the desired location and is attached by direct adhesion. Direct molding further allows having a small quantity of material entering the space between the parts before solidifying. Advantageously, the dielectric tether (40, 40') may be attached to the hot arm member (20, 20') and the cold arm member (30, 30') in a different manner than the one shown in the figures. Moreover, the dielectric tethers (40, 40') can be transparent as illustrated in some of the figures.

Each dielectric tether (40, 40') is preferably made entirely of a photoresist material. It was found that a very suitable material for that purpose, which is also easy to manufacture, is the material known in the trade as "SU-8". The SU-8 is a negative, epoxy-type, near-UV photo resist based on EPON SU-8 epoxy resin (from Shell Chemical). Of course, other photoresist may be used as well, depending upon the particular design requirements. Other possible suitable materials include polyimide, spin on glass, oxide, nitride, ORMOCORE™, ORMOCLAD™ or other polymers. Moreover, combining different materials is also possible and well within the scope of the present invention. As can be appreciated, providing each dielectric tether (40, 40') over the corresponding actuator (10, 10') is advantageous because it allows using the above-mentioned materials, which in return provides more flexibility on the tether material and a greater reliability.

In use, when a control voltage is applied at the anchor pads (24, 24') of the hot arm member (20, 20'), a current travels into the first and second portions (22, 22'). In the various embodiments illustrated herein, the material(s) comprising the hot arm members (20, 20') is a substantially conductive material selected so that it increases in length as it is heated. The cold arm members (30, 30'), however, do not substantially exhibit such elongation since no current is initially passing through them. The result of this arrangement is that when a control voltage is applied at the anchor pads (24, 24'), the resulting current flow in the hot arm members (20, 20') results in their heating, and the free end of each actuator (10, 10') is deflected sideward because of the asymmetrical configuration of the parts, thereby moving the actuators (10, 10') from a neutral position to a deflected position. Conversely, removing the control voltage from the anchor pads (24, 24') results in the cooling of the hot arm member (20, 20') thereby causing it to move to its original position. Advantageously, both movements (from neutral to deflected and deflected back to neutral) occur very rapidly.

Preferably, each cold arm member (30, 30') comprises a narrower section (36, 36') adjacent to its anchor pad (32, 32') in order to facilitate the movement between the neutral position and the deflected position. Each narrower section (36, 36') has a width laterally decreased from the exterior compared to a wider section (38, 38') of the cold arm member (30, 30'). In the preferred embodiment, the width decrease is at a square angle. As can be appreciated by those skilled in the art, other shapes are possible as well.

Each of the actuators (10, 10') in the embodiment shown in FIG. 1 includes a set of two spaced-apart additional dielectric tethers (50, 50'). These additional dielectric tethers (50, 50') are transversally disposed over the portions (22, 22') of the hot arm member (20, 20') and over the cold arm member (30, 30'). Generally, they adhere to these parts.

It is advantageous to provide at least one of these additional dielectric tethers (50, 50') on each actuator (10, 10') so as to provide additional strength to the hot arm member (20, 20') by reducing their effective length, thereby preventing distortion of the hot arm member (20, 20') over time. Since the gap between the parts is extremely small, the additional tethers (50, 50') reduce any risk of a short circuit between the two portions (22, 22') of the hot arm member (20, 20') or between the portion (22, 22') of the hot arm member (20, 20') which is physically the closest to the cold arm member (30, 30') and the cold arm member (30, 30') itself by keeping them in a spaced-apart configuration.

Additionally, since the cold arm member (30, 30') can be used to carry high voltage signals in some configurations, the portion (22, 22') of the hot arm member (20, 20') closest to the cold arm member (30, 30') may deform, thereby moving closer towards the cold arm member (30, 30') due to the electrostatic force between them created by the high voltage signal. If the portion (22, 22') of the hot arm member (20, 20') gets too close to the cold arm member (30, 30'), a voltage breakdown can occur, destroying the MEMS switch (100). Finally, since the two portions (22, 22') of the hot arm member (20, 20') are relatively long, they tend to distort when heated to create the deflection, thereby decreasing the effective stroke of the actuators (10, 10').

As can be appreciated, using one, two or more additional dielectric tethers (50, 50') has many advantages, including increasing the rigidity of the portions (22, 22') of the hot arm member (20, 20'), increasing the stroke of the actuators (10, 10'), decreasing the risks of shorts between the portions (22, 22') of the hot arm members (20, 20') and increasing the breakdown voltage between the cold arm members (30, 30') and hot arm members (20, 20').

The additional dielectric tethers (50, 50') are preferably made of a material identical or similar to that of the main dielectric tethers (40, 40'). Small quantities of materials are advantageously allowed to flow between the parts before solidifying in order to improve the adhesion. In addition, one or more holes or passageways (not shown) can be provided in the cold arm members (30, 30') to receive a small quantity of material before it solidifies to ensure a better adhesion.

The additional tethers (50, 50') are preferably provided at enlarge points (22*a*, 22*a'*) along the length of each actuator (10, 10'). These enlarged points (22*a*, 22*a'*) offer a greater contact surface and also contribute to dissipate more heat when a current flows therein. Providing a larger surface and allowing more heat to be dissipated increase the actuator life time Continuing with our discussion of FIG. 1, it may be observed that this figure further shows that each actuator (10, 10') of the preferred embodiment comprises a corresponding tip member (60, 60') attached to the free end (34, 34') of the cold arm member (30, 30'). In this configuration, the tip members (60, 60') are used to perform a mechanical latch enabling the MEMS switch (100) to remain in its "on" positions without requiring power. In some other configurations where we need to create an electrical connection between the tip members (60, 60'), the surface of the contact flanges (62, 62') of each tip member (60, 60') is preferably designed so as to lower the contact resistance when two of such tip members (60, 60') make contact with each other. This can be obtained by using tip members (60, 60') made of gold, either entirely made of gold or gold-over plated. Other possible materials include a gold-cobalt alloy, palladium, etc. Such materials provide a lower contact resistance in comparison with nickel, which is the preferred material for the cold arm members (30, 30'). The hot arm members (20, 20') are also preferably made of nickel. Other materials can be used for the hot arm members (20, 20') and the cold arm members (30, 30').

Turning our attention now to FIG. 2*a*, there it shows that the tip member (60') of one actuator (10') is attached under the free end (34, 34') of the corresponding cold arm member (30, 30'). Preferably, it is attached using the natural adhesion of the materials when plated over each other, although other means can be used as well. If the tip members (60, 60') are made of Nickel then it would be built simultaneously with the Nickel cold and hot arms and would therefore be an integral part of the cold arm member (30, 30').

FIGS. 3*a* through 3*e* schematically show an example of the relative movement of the MEMS actuators (10, 10') when the MEMS switch (100) goes from an "open position" to a "closed position", thereby closing the circuit between the two contact terminals (102, 104). To move from one position to the other, the actuators (10, 10') are operated in sequence.

Figure 3A:
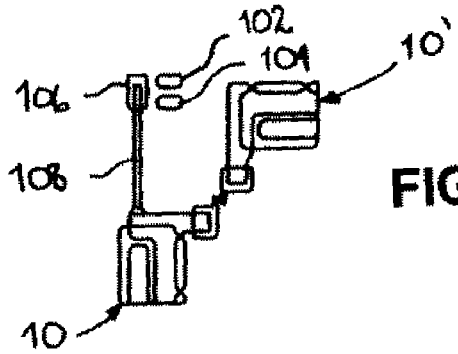
FIGS. 3*a*-3*e* show schematically an example of the relative movement of the MEMS actuators of FIGS. 2*a* and 2*b* when they go from "open" to "closed" position.
Figure 3B:
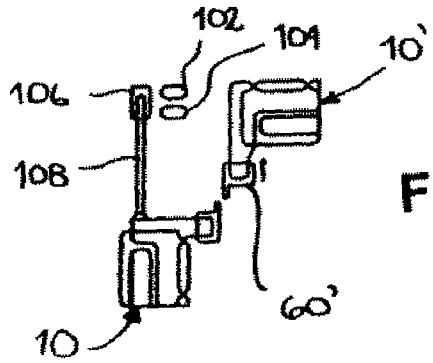
Figure 3C:
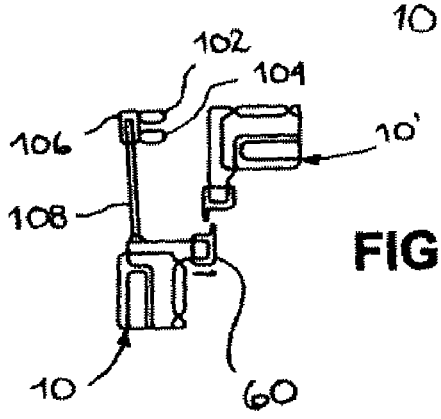

More particularly, FIG. 3*a* shows the initial position of the MEMS switch (100). In FIG. 3*b*, the hot arm member of the second actuator (10') is activated so that the tip member (60') is deflected to its right. Then, in FIG. 3*c*, the tip member (60) of the first actuator (10) is deflected to its right upon activation of the corresponding hot arm member.

Figure 3D:
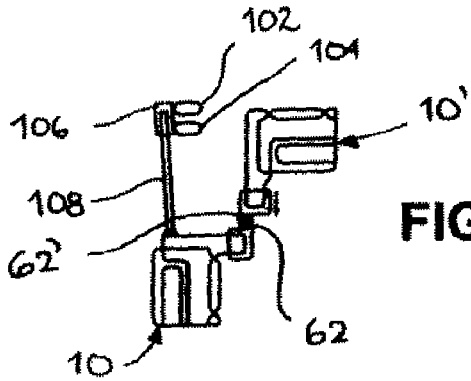
Figure 3E:
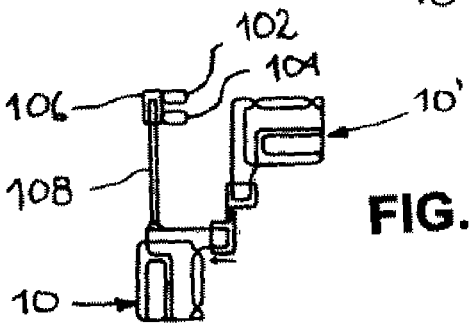

FIG. 3*d* shows the control voltage in the second actuator (10') being released, which causes its flange (62') to engage the back side of the flange (62) of the first actuator (10) as it returns towards its neutral position. Then, in FIG. 3*e*, the control voltage of the first actuator (10) is subsequently released, thereby allowing a stable engagement between both actuators (10, 10'). The closing of the MEMS switch (100) is very rapid, all this occurring in typically a few milliseconds. Advantageously, the MEMS switch (100) can be opened by reversing the above-operations.

As can be seen, the movable conductive member (106) is moved, in FIG. 3*a* to FIG. 3*e*, from a position where it is out of engagement with the contact terminals (102, 104), to a position where it is urged against the contact terminals (102, 104) such that a circuit is closed. The support arm (108) is slightly bent when the circuit is closed, this creating a spring force which maintains the conductive member (106) in a good positive engagement. A signal or simply a current can then be transmitted between both corresponding contact terminals (102, 104). It should be noted at this point that if required, the MEMS actuators (10, 10') can still be used to transmit a signal through their own structure, although this path would not be as optimum as the one between the two contact terminals (102, 104). In that case, the free end (34) would include a dielectric tether to electrically insulate the support arm (108) and the actuator (10).

Figure 4:
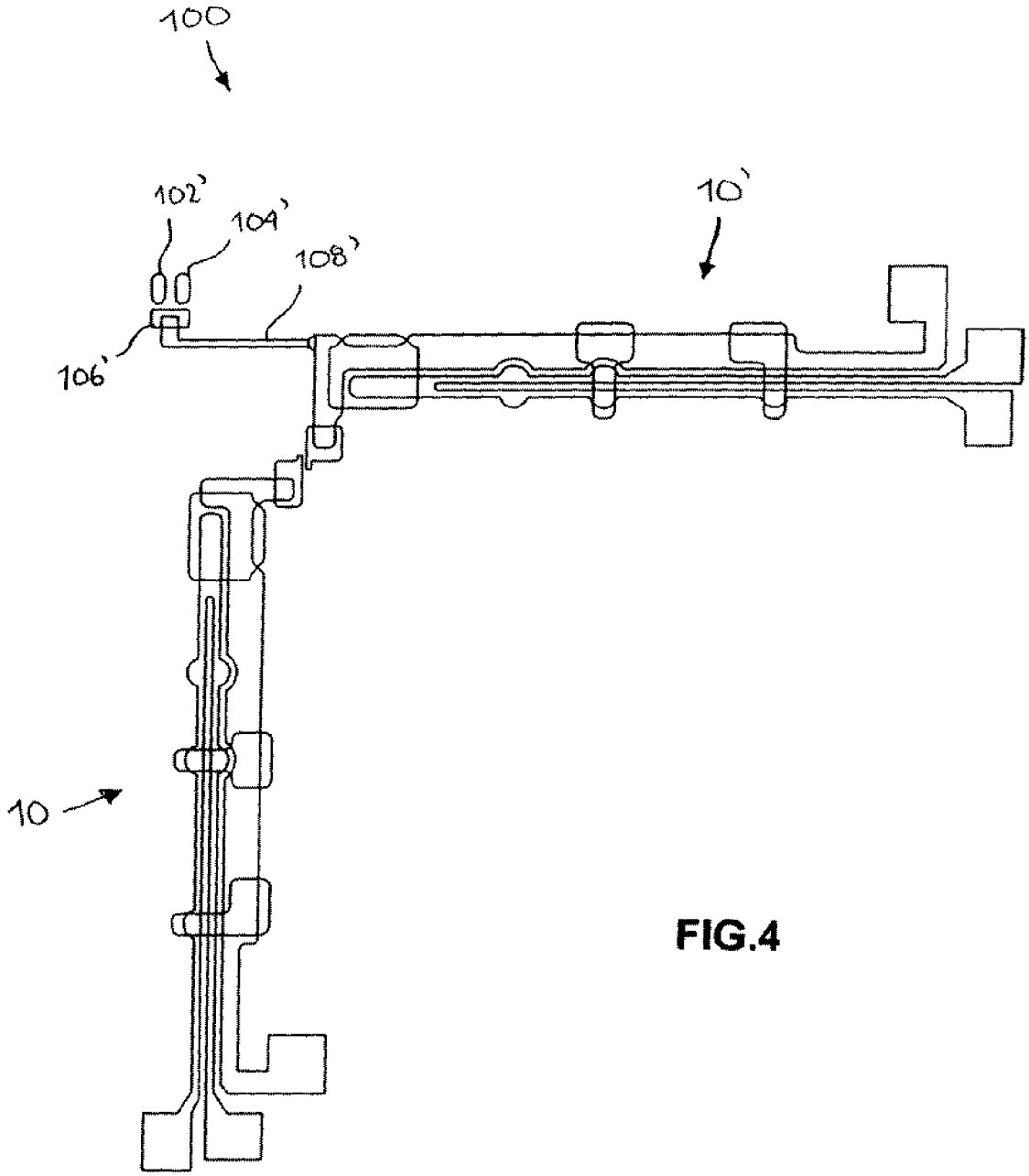
FIG. 4 shows a schematic of an alternate embodiment of the exemplary MEMS switch of FIG. 1.

FIG. 4 illustrates an alternate embodiment. This embodiment is similar to the one illustrated in FIG. 1, with the exception that it comprises a movable conductive member (106') to engage contact terminals (102', 104') and a corresponding support arm (108') mounted on the second actuator (10').

Figure 5:
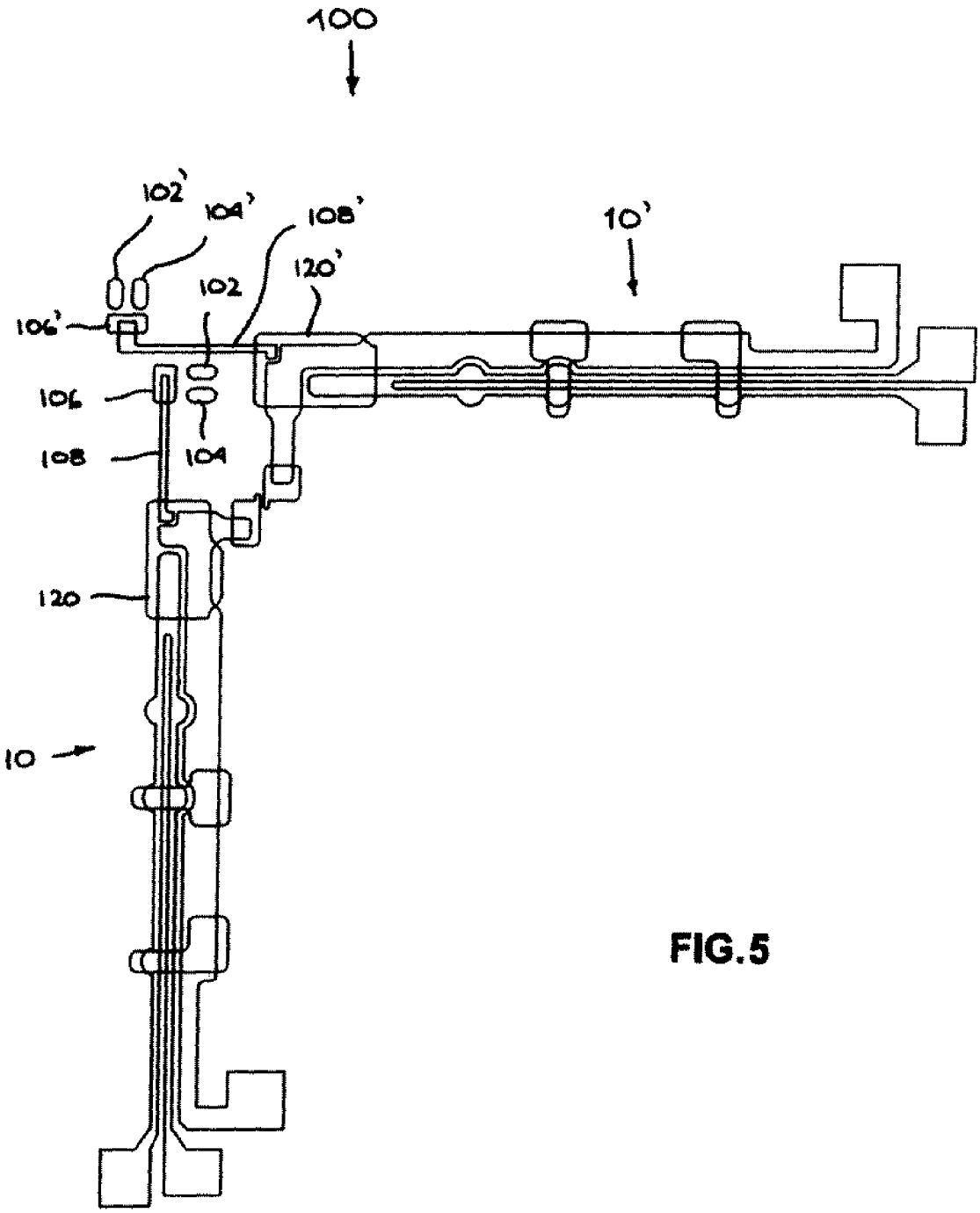
FIG. 5 shows a schematic of another alternate embodiment of the exemplary MEMS switch of FIG. 1.

FIG. 5 illustrates another alternate embodiment of our inventive MEMS switch structure. It comprises the two movable conductive members (106, 106') and the two corresponding support arms (108, 108'). When closed, this MEMS switch (100) simultaneously creates two circuits. In this embodiment, a dielectric tether (120, 120') is provided between each free end (34, 34') and the corresponding support arms (108, 108') to electrically insulate each contact.

Figure 6A:
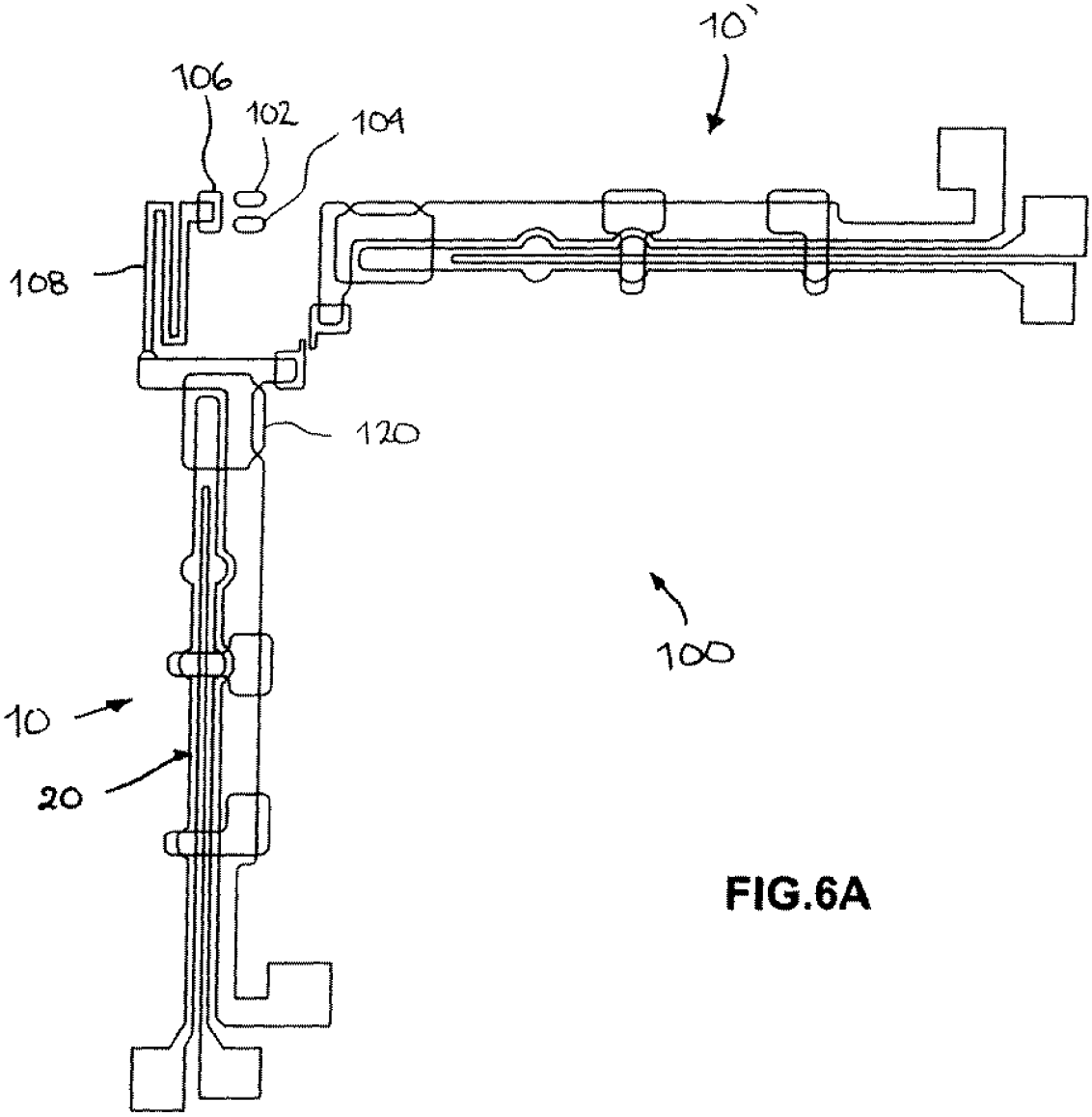
FIG. 6*a* shows a schematic of yet another alternate embodiment of the exemplary MEMS switch of FIG. 1.

FIG. 6A illustrates a further alternate embodiment. It comprises a movable conductive member (106) being located at the end of a support arm (108) having a plurality of parallel segments. This spring-like configuration provides more flexibility to the support arm (108) when the movable conductive member (106) abuts on the two contact terminals (102, 104). As can be readily appreciated, flexibility may have an effect on contact resistance and life cycle.

Figure 6B:
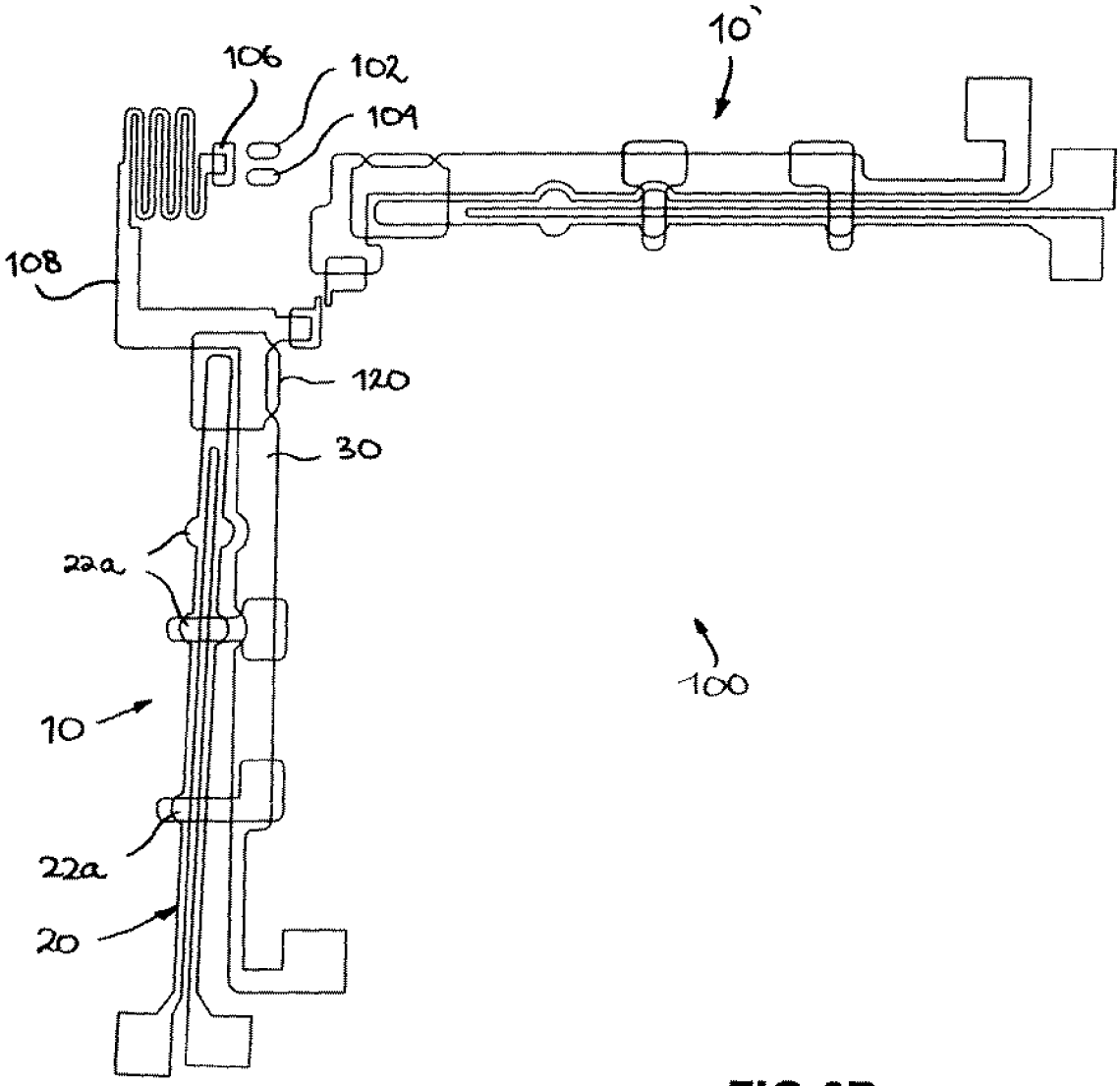
FIG. 6B is a schematic which shows an alternate embodiment of the MEMS switch of FIG. 6A, wherein inter alia one of the, MEMS actuators of the switch has a hot arm member being set at an angle with reference to the cold arm member.

FIG. 6B shows a variation of the embodiment shown in FIG. 6A. One of the MEMS actuators (10, 10') of the switch (100) has a hot arm member (20) being set at an angle with reference to the cold arm member (30). Advantageously, this angular offset provides some compensation for the supplemental stress exerted by the support arm (108) on the dielectric tether (120) when the MEMS switch (100) is closed.

In addition, this angular offset also prevents the actuator (10) from moving away from its original position after many cycles—as a result of fatigue. Without the angle on the hot arm member (20) the gap between the movable contact member (106) and the contact terminals (102, 104) may gradually increase over time with repeated cycling. As can be readily appreciated by those skilled in the art, this angle provides a greater lateral stability to the actuator (10).

Figure 6C:
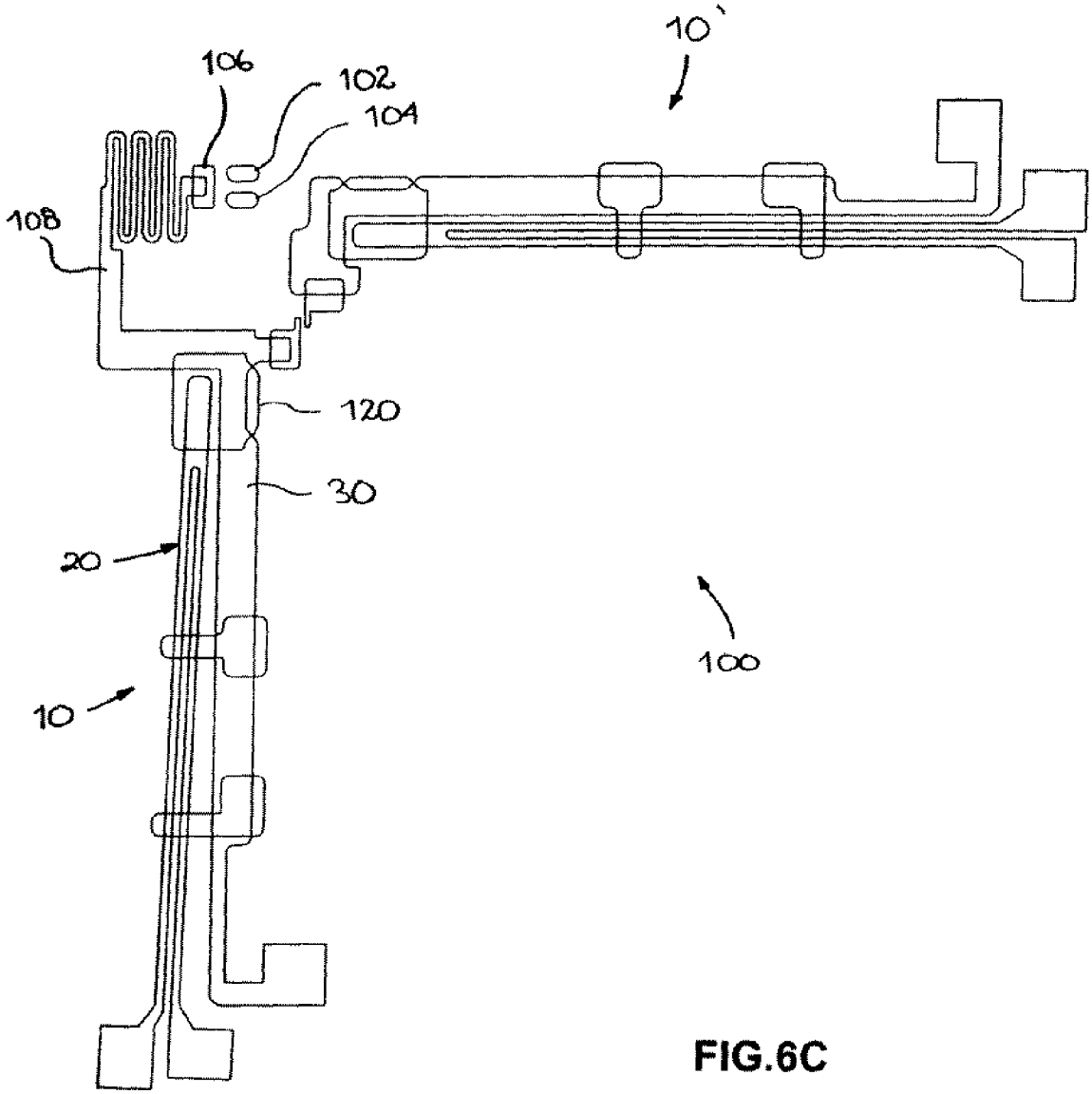
FIG. 6C is a schematic which shows an alternate embodiment of the exemplary MEMS switch of FIG. 6B wherein the actuators are not provided with enlarged points.

Preferably, the support arm (108) is made integral with the cold arm member (30) and is designed with a rigid base portion and a spring-like portion somewhat symmetrically disposed around a central axis extending towards and between the contact terminals (102, 104). FIG. 6C shows a variation of the structure shown in FIG. 6B, whereby the actuators (10,10') are not provided with enlarged points (22*a*, 22*a'*).

Figure 7:
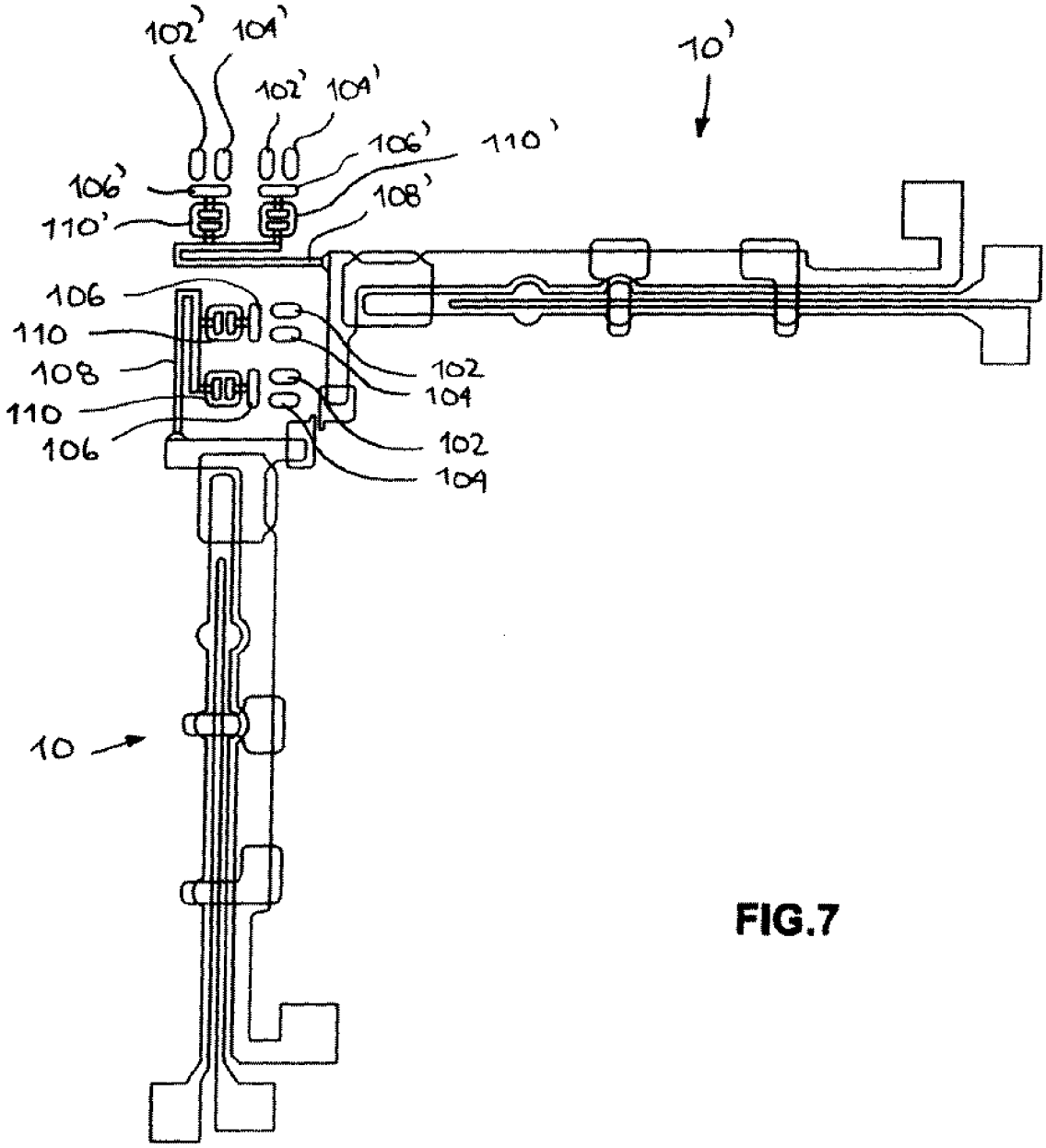
FIG. 7 shows a schematic of yet another alternate embodiment of the exemplary MEMS switch of FIG. 1 wherein four sets of contact terminals are employed.

FIG. 7 shows another alternate embodiment, whereby four sets of contact terminals (102, 104 and 102', 104') are used. Each support arm (108, 108') carries two corresponding movable contact members (106, 106') and is shaped in a spring-like configuration having two substantially parallel segments. Each movable contact member (106, 106') is made electrically independent from the support arm (108) by a corresponding tether (110, 110').

Figure 8:
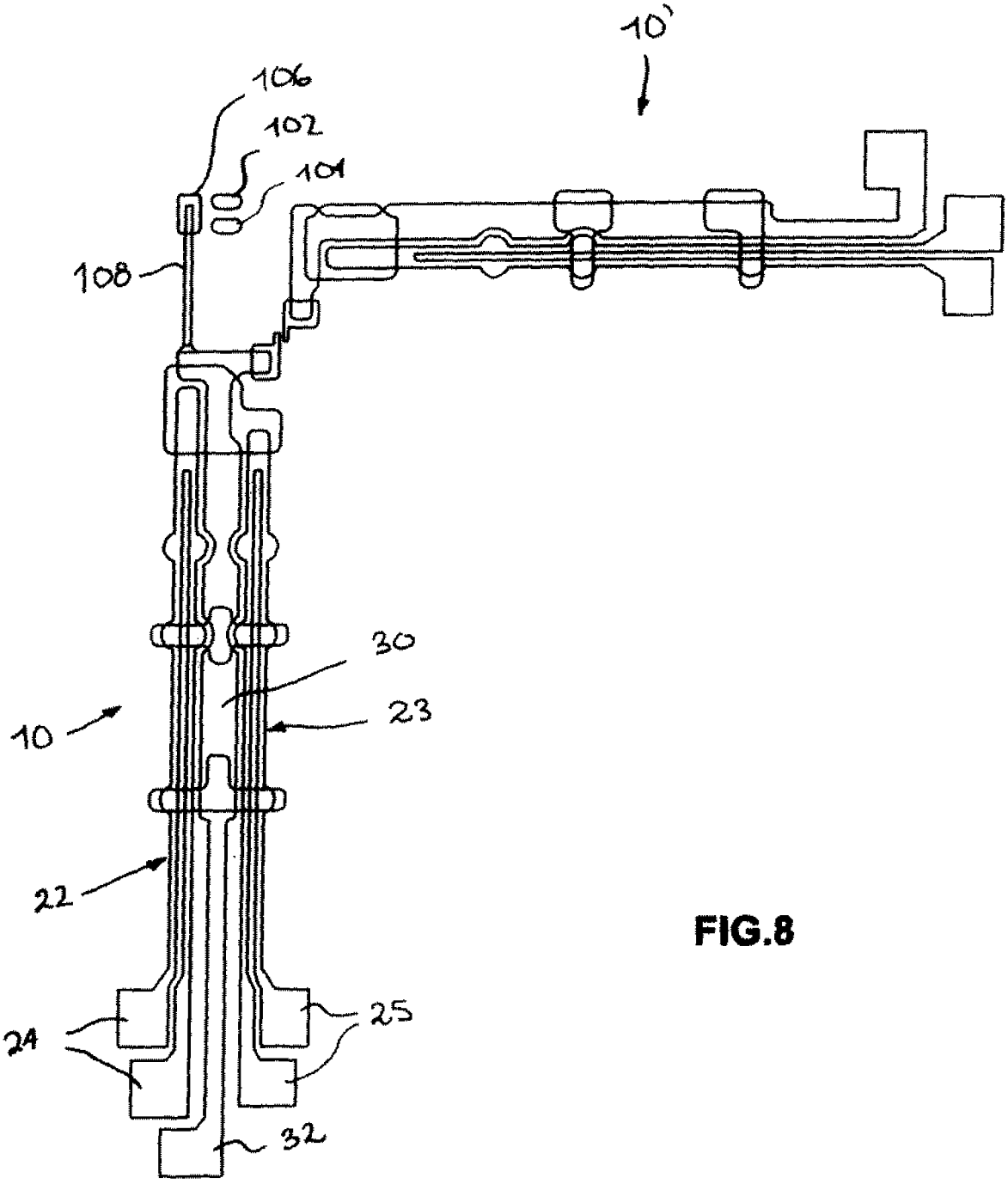
FIG. 8 is a schematic of yet another alternate embodiment of the MEMS switch of FIG. 1 wherein one actuator is provided with a second hot arm member.

FIG. 8 shows an alternate embodiment on the MEMS switch (100) in which one of the actuators (10, 10') is provided with a second hot arm member (23) opposite the first hot arm member (22). The second hot arm member (23) has two corresponding anchor pads (25). This second hot arm member (23) is activated during the release of the MEMS switch (100) from a closed position to an open position. This may be useful to counteract sticktion forces or micro-weld, if any, that could occur between the movable conductive member (106) and the two contact terminals (102, 104). If these forces exceed the natural return force when the actuator (10) goes back to its initial position, then the second hot arm member (23) can provided the additional necessary force on the opposite side to counteract them.

Figure 9:
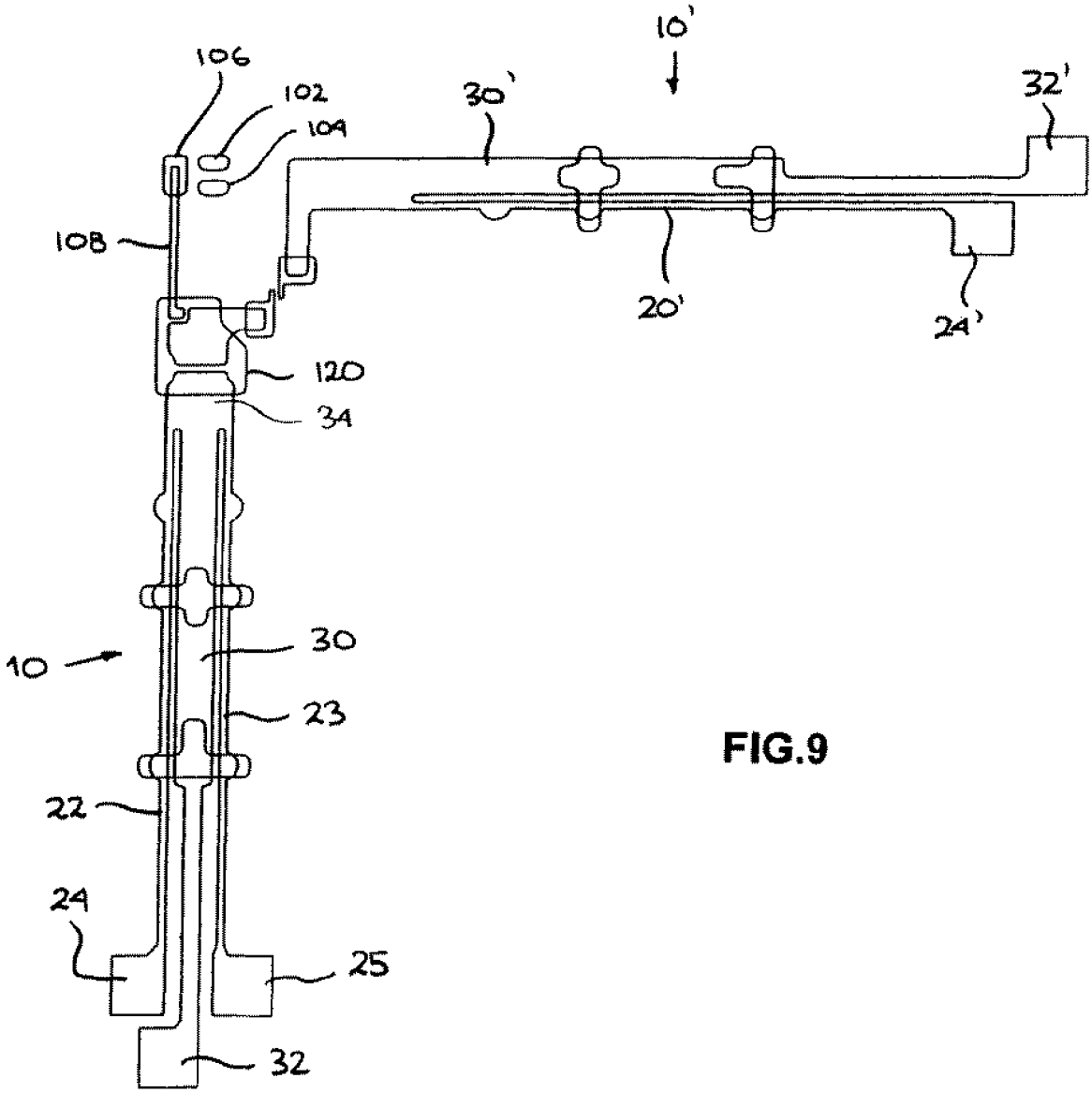
FIG. 9 is a schematic of another alternate embodiment of the MEMS switch of FIG. 1 employing a single hot arm member.

FIG. 9 illustrates another alternate embodiment in which each actuator (10, 10') are built using single hot arm members instead of dual hot arm members. This configuration reduces the total size and increase the flexibility of the MEMS switch (100). On the other hand, a single hot arm member configuration reduce the effective stroke and forces applied to the contact terminals (102, 104). One actuator (10) has three anchor pads (24, 25, and 32) but has two single hot arm members (22, 23), the other actuator (10') has two anchor pads (24' 32') but only a one-portion hot arm member (20') that is directly connected to the cold arm member (30'). A dielectric tether (120) is provided between free end (34) and support arm (108) and between free end (34) and cold arm member (30).

FIGS. 10 to 18 illustrate a different class of MEMS switches (100). In these MEMS switches (100), the movable conductive member (106) is moved vertically during the process of opening or closing the circuit.

Figure 10:
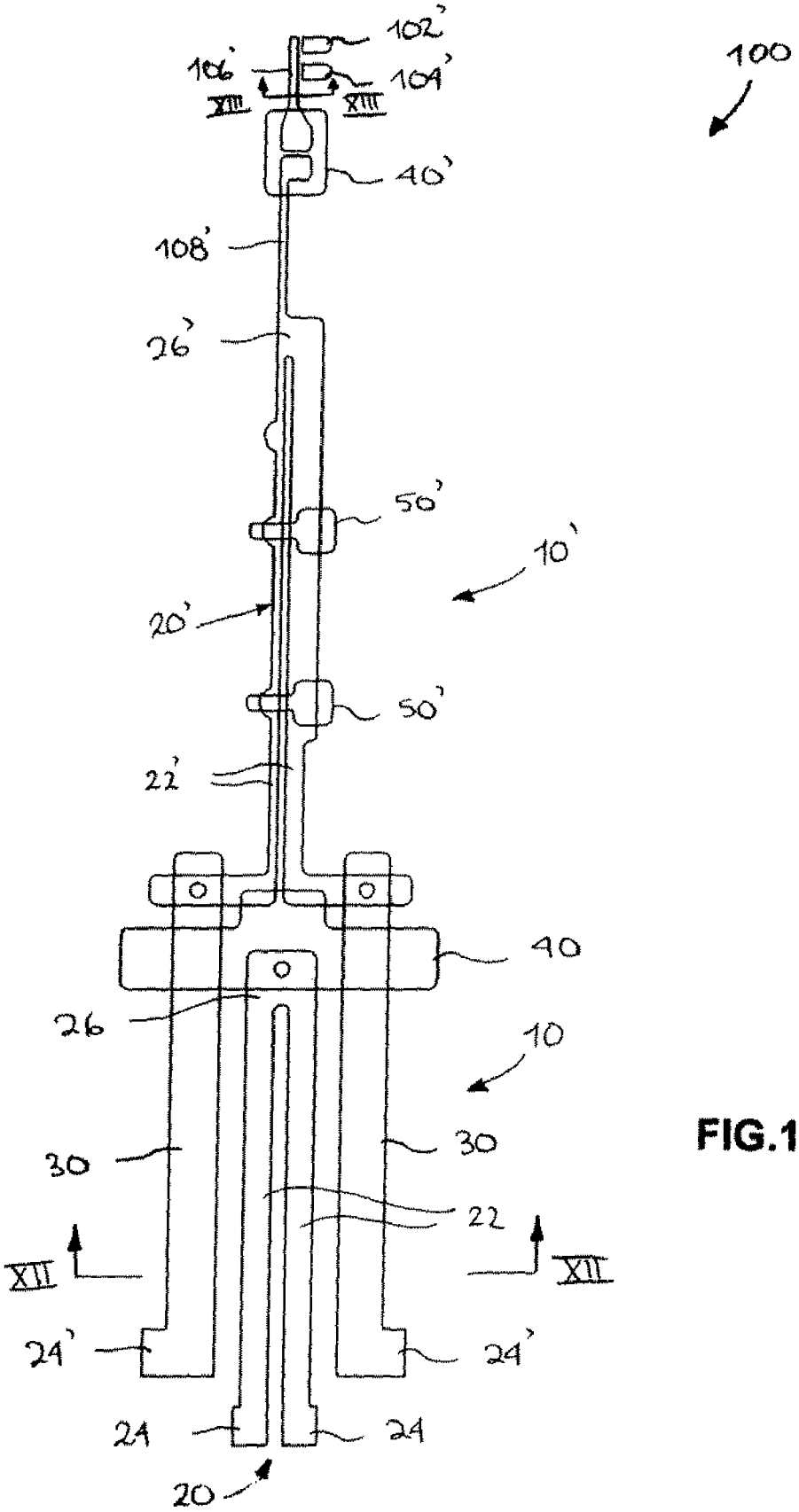
FIG. 10 is a schematic of another alternate embodiment of the MEMS switch of FIG. 1.
Figure 11:
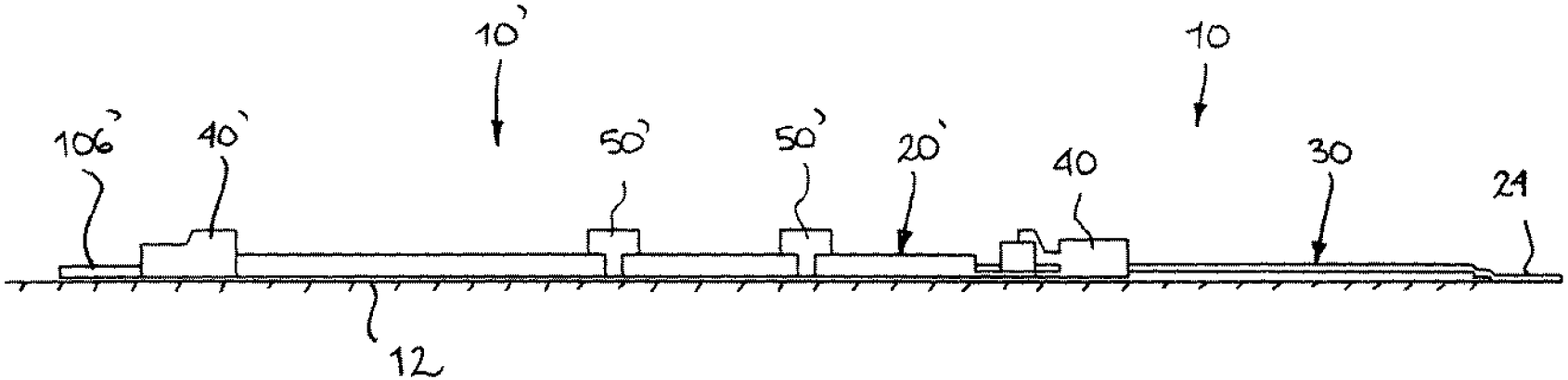
FIG. 11 is a left-side view of the embodiment of FIG. 10.
Figure 12:
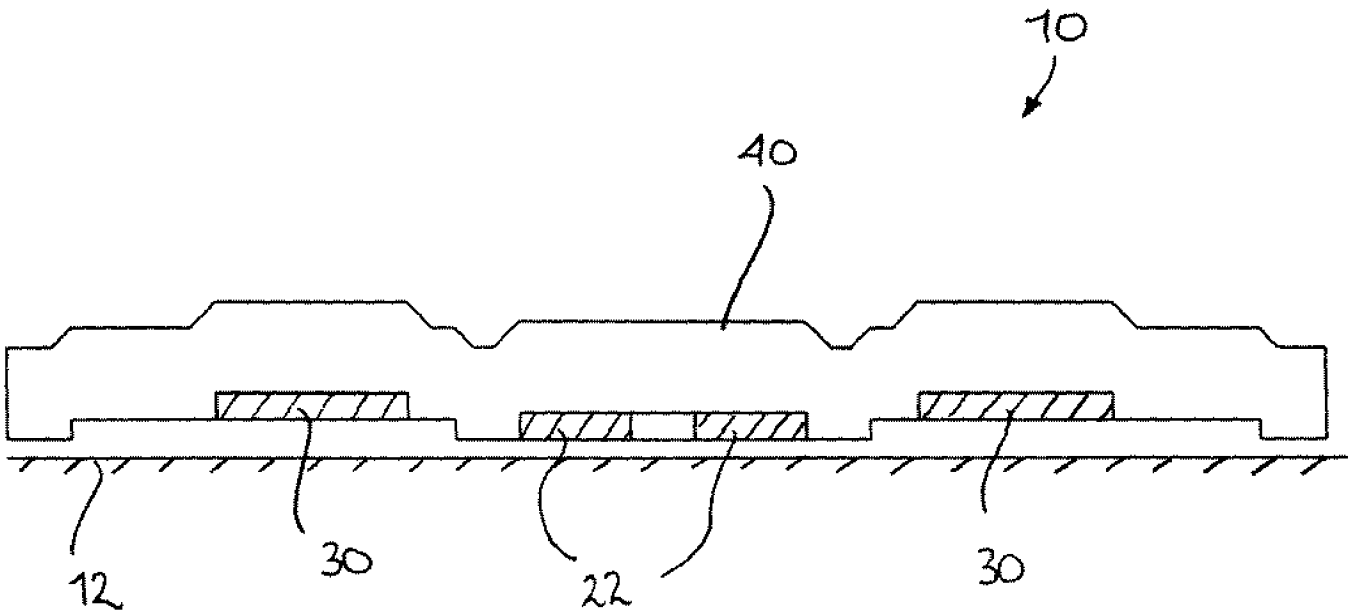
FIG. 12 is a cross-sectional view of the embodiment of FIG. 10.

In FIG. 10, the portion closer to the anchor pads (24, 24') is the first actuator (10) which moves the second actuator (10') vertically using portions (22) of the hot arm member (20). The electrical current is supplied to the second actuator (10') through the anchor pads (24') and the arm members (30) of the first actuator (10). The first and the second actuators (10, 10') are connected together by means of a tether (40). When activated, the portions (22') of the hot arm member (22) of the second actuator (10') moves the support arm (108') and the movable conductive member (106') to the right. The support arm (108') is electrically insulated from the movable conductive member (106') by means of a tether (40'). FIG. 11 is a left side view of this arrangement. FIG. 12 is a cross-sectional view taken along line XII-XII in FIG. 10.

Figure 13A:
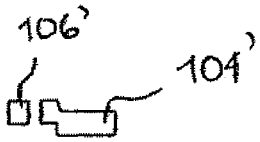
FIG. 13*a*-13*e* show the sequence of operation of the MEMS switch of FIG. 10.
Figure 13B:
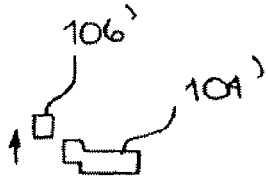

FIGS. 13*a* to 13*e* show the sequence of operation of the MEMS switch (100) of FIGS. 10 to 12, as viewed from line XIII-XIII in FIG. 10. The initial "open" position is shown in FIG. 13*a*. FIG. 13*b* shows the movable conductive member (106') being raised as the first actuator is activated. When the first actuator is activated, its hot arm member is heated by an electric current flowing therein. This increases the length of the hot arm member. Since the hot arm member (20) is slightly vertically offset with reference to the cold arm members (30), as shown in FIG. 12, the end of the first actuator (10) which is away from the corresponding anchor pads will be lifted vertically. Consequently, the second actuator (10'), the support arm (108') and the movable conductive member (106') will be raised as well.

Figure 13C:
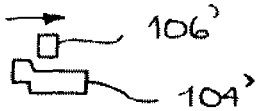
Figure 13D:
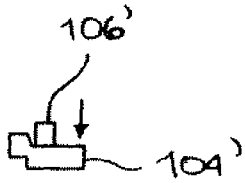
Figure 13E:
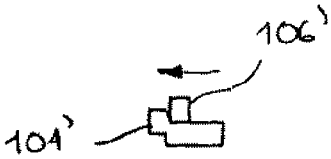

FIG. 13*c* shows the position of the movable conductive member (106'), with reference to one of the contact terminal (104') once the second actuator (10') is powered. Then, the voltage in the first actuator is released so that the first actuator is forced to return to its initial position. The movable conductive member (106') will move downwards until it makes contact with the contact terminal (104'). Finally, the voltage is released from the second actuator and the free end of the second actuator will be forced to return towards its initial position at the left. This will maintain a force between the contact terminal (104') and the movable conductive member (106'). It should be noted that all this procedure is occurring in an extremely short time and that it can be reversed by reversing the above-mentioned steps.

Figure 14:
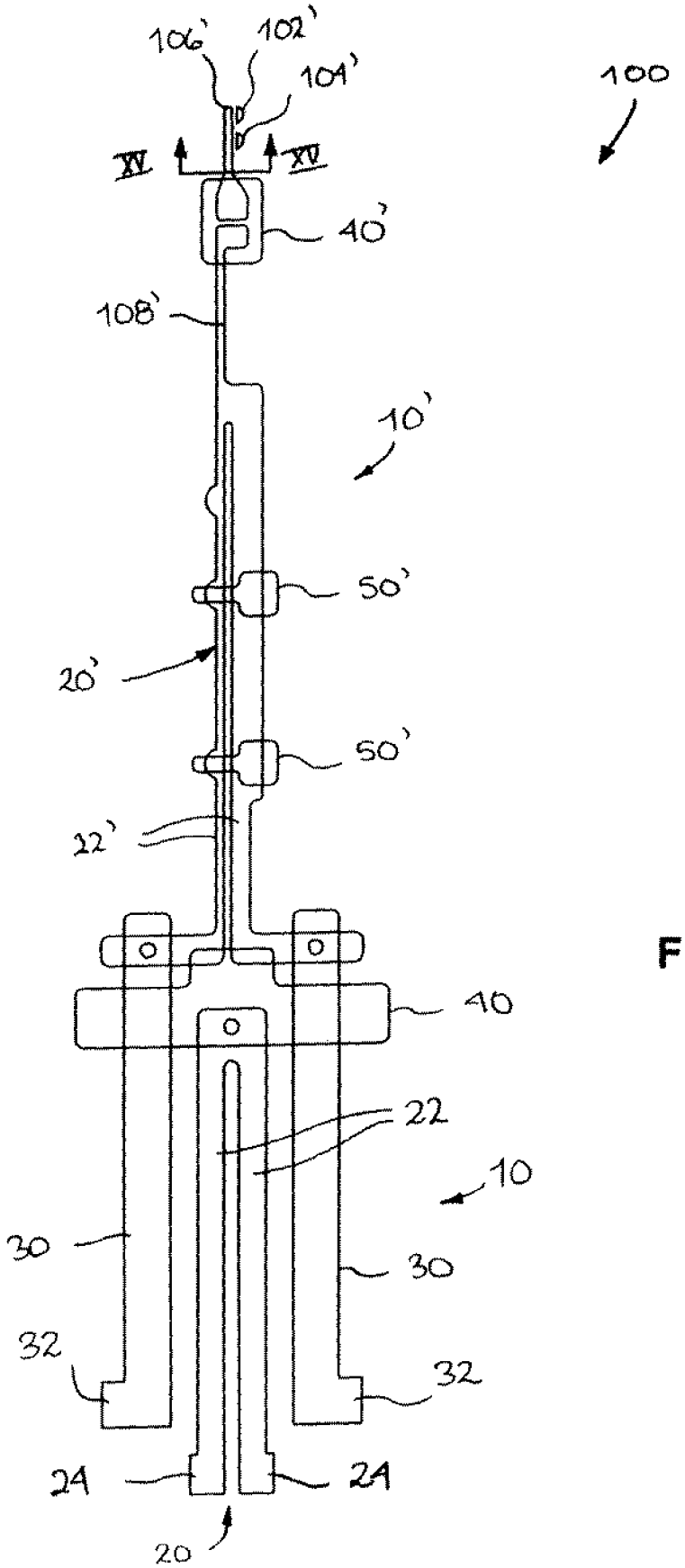
FIG. 14 shows a schematic of an alternative embodiment of the MEMS switch of FIG. 10.
Figure 15A:
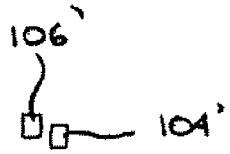
FIG. 15*a*-15*e* show the sequence of operation of the MEMS switch of FIG. 14.
Figure 15B:
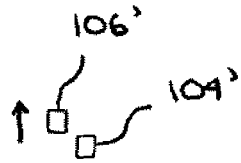
Figure 15C:
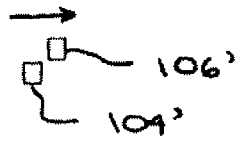
Figure 15D:
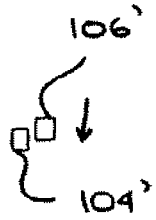
Figure 15E:
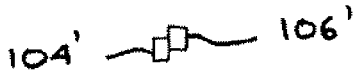

FIG. 14 illustrates an alternative embodiment that is somewhat similar to that of FIGS. 10 to 12. In this embodiment, the contact terminals (102', 104') do not provide a horizontal support to the movable conductive member (106') when the MEMS switch (100) is in a closed position. FIGS. 15*a* to 15*e* illustrate the various steps for closing the circuit. These steps are similar to that of FIGS. 13*a* to 13*e*, with the exception that the movable conductive member (106') will not rest over the contact terminal (104') when the circuit is closed.

Figure 16:
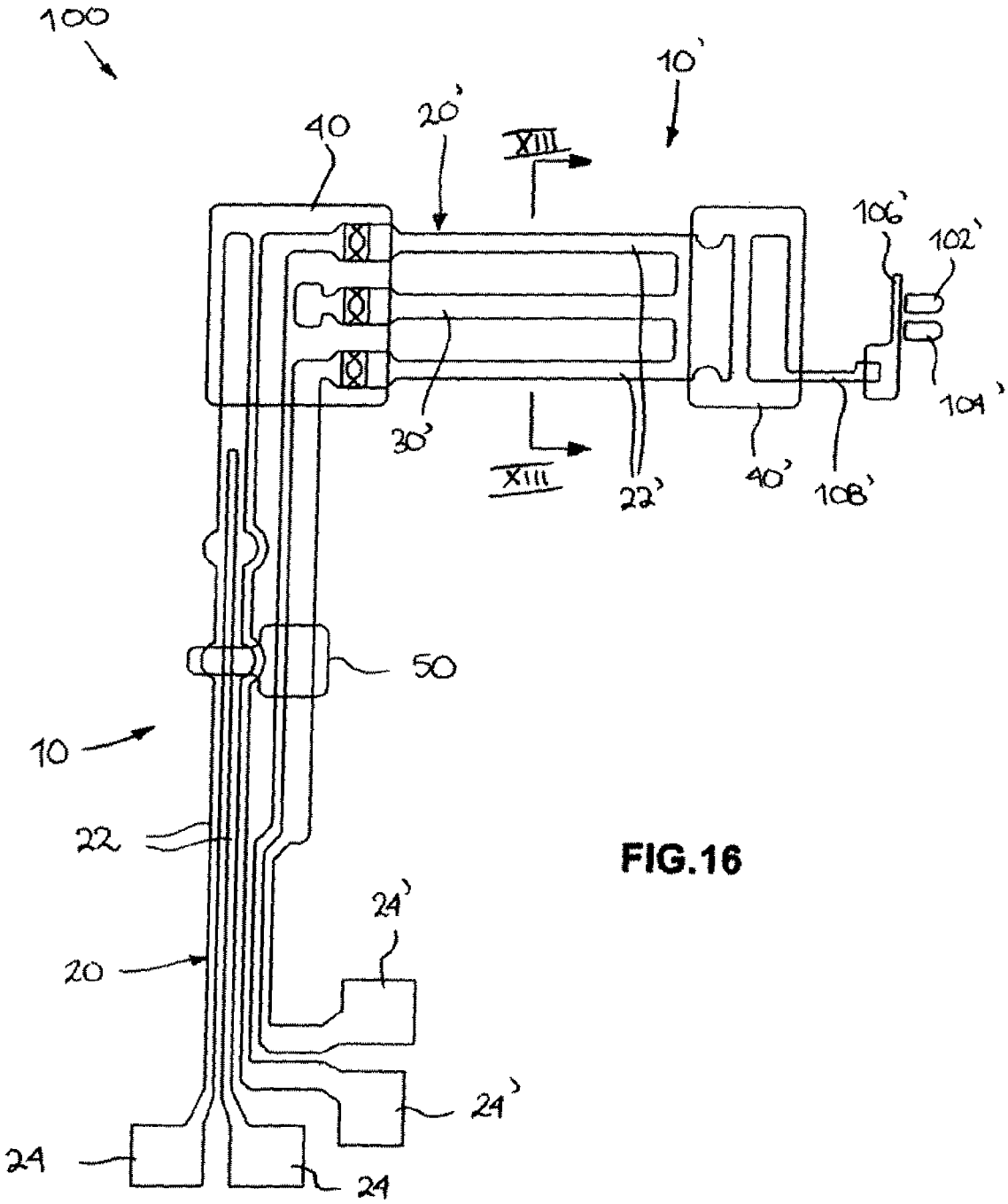
FIG. 16 shows a schematic of another alternative embodiment of the MEMS switch of FIG. 1.
Figure 17:
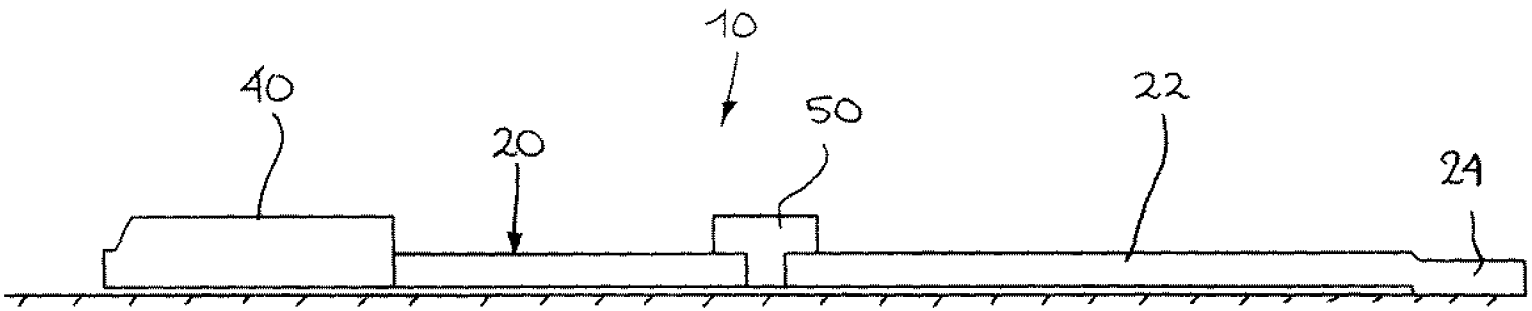
FIG. 17 is a side-view of the MEMS switch of FIG. 16.
Figure 18:
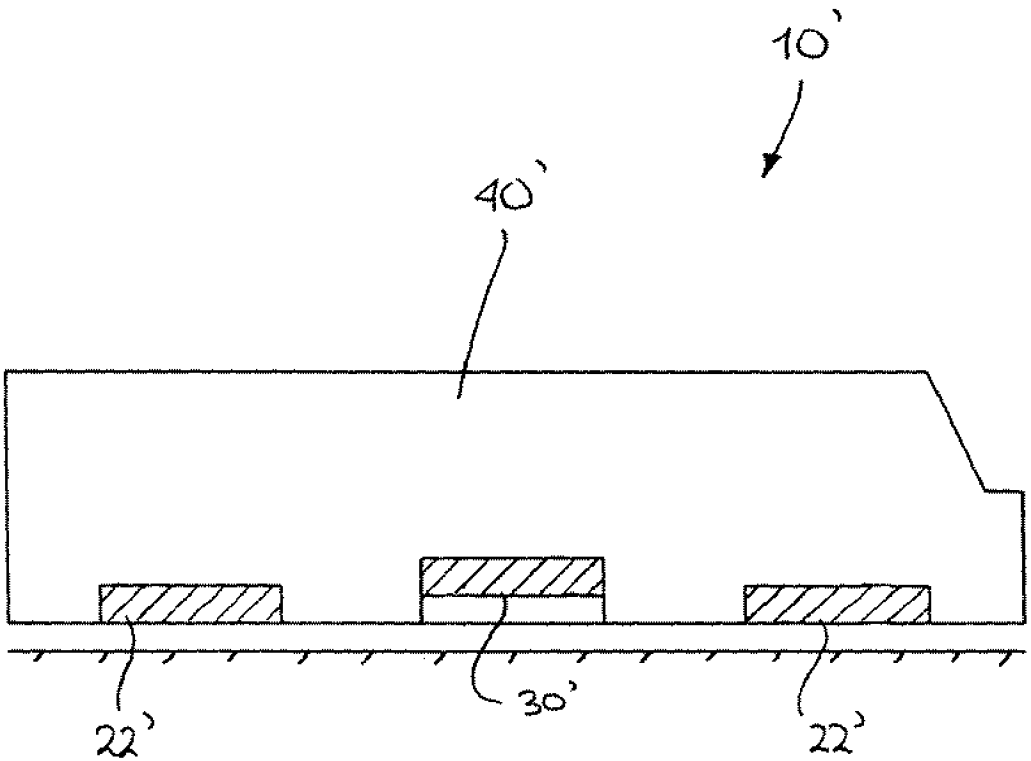
FIG. 18 is a cross-sectional view of the MEMS switch of FIG. 17.

FIGS. 16 to 18 illustrate another embodiment. In this embodiment, the first actuator (10) moves the movable conductive member (106') in a horizontal plane. The second actuator (10') moves the movable conductive member vertically. The operation of this embodiment remains similar to that illustrated in FIGS. 13*a* to 13*e*, so that the parts not referred to in this section refers to the same element in FIGS.

10 to 14. FIG. 17 shows a side view of this configuration. FIG. 18 shows a cross-section taken along line XVIII-XVIII in FIG. 16.

As can be seen in FIG. 16, the "cold arm member" (30') can be integrated to the hot arm member (20'). However, since no current will flow therein, the cold arm member (30') will remain at the same length when the current flows into the two portions (22') of the hot arm member (20'). Since the two portions (22') of the hot arm member (20') are slightly below the level of the cold arm member (30), the support arm (108') and the movable conductive member (106') will be moved upwards.

As can be appreciated, the various configurations of the MEMS switch (100) disclosed herein can be designed to withstand a relatively large current between the contact terminals. Advantageously, this current may be in excess of one ampere, possibly even more. Therefore, current limiters may be omitted from the system design using this MEMS switch configuration. Typically, each actuator (10, 10') is activated with a current between 50 to 200 mA. Other values are also possible.

It is understood that the above-described embodiments are illustrative of only a few of the possible specific embodiments which can represent applications of the invention. Numerous and various other arrangements and materials may be made by those skilled in the art without departing from the spirit and scope of the invention.

Accordingly, our invention should only be limited by the scope of the attached claims.

What is claimed is:

1. A microelectromechanical system (MEMS) switch structure, said switch structure comprising:

a first pair of spaced-apart, stationary electrical contacts each of said first pair of spaced-apart, stationary electrical contacts providing a first switch input;

a first MEMS actuator;

a first support arm operatively connected to the first MEMS actuator;

a first moveable conductive member operatively mounted to the first support arm such that the first moveable conductive member is selectively deflected by activation of said first MEMS actuator with respect to said first pair of spaced-apart, stationary electrical contacts to thereby selectively switch between a first switch open position and a first switch closed position;

a second pair of spaced-apart, stationary electrical contacts, each of said electrical contacts providing a second switch input;

a second MEMS actuator;

a second support arm operatively connected to the second MEMS actuator;

a second moveable conductive member operatively mounted to the second support arm such that the second moveable conductive member is selectively deflected by activation of said second MEMS actuator with respect to said second pair of spaced-apart, stationary electrical contacts to selectively switch between a second switch open position and a second switch closed position.

2. The microelectromechanical system (MEMS) switch structure as claimed in claim 1, wherein said first MEMS actuator comprises a first elongated hot arm member, a first elongated cold arm member and a first dielectric tether, further wherein said first dielectric tether operatively couples the first elongated hot arm member and the first elongated cold arm member, further wherein said first support arm is operatively connected to the first elongated cold arm member.

3. The microelectromechanical system (MEMS) switch structure as claimed in claim 2, wherein said first hot arm member comprises two spaced-apart portions, each of said two spaced-apart portions having a corresponding anchor pad for receiving a voltage.

4. The microelectromechanical system (MEMS) switch structure as claimed in claim 2, wherein said first dielectric tether is made of a photoresist material.

5. The microelectromechanical system (MEMS) switch structure as claimed in claim 2, further comprising a first set of at least two additional tethers, each disposed over a portion of the first hot arm member and the first cold arm member.

6. The microelectromechanical system (MEMS) switch structure as claimed in claim 2, wherein said first MEMS actuator further comprises a second elongated hot arm member, further wherein said first dielectric tether operatively couples the first elongated hot arm member, the first elongated cold arm member and the second elongated hot arm member.

7. The microelectromechanical system (MEMS) switch structure as claimed in claim 2, wherein the first elongated hot arm member is set at an angle with respect to the first elongated cold arm member.

8. The microelectromechanical system (MEMS) switch structure as claimed in claim 1, further wherein each of said first MEMS actuator and said second MEMS actuator comprises a corresponding tip member for performing a mechanical latch.

9. The microelectromechanical system (MEMS) switch structure as claimed in claim 8, wherein said second MEMS actuator comprises a second MEMS actuator elongated hot arm member, a second MEMS actuator elongated cold arm member and a second MEMS actuator dielectric tether, further wherein said second MEMS actuator dielectric tether operatively couples the second MEMS actuator elongated hot arm member and the second MEMS actuator elongated cold arm member.

10. The microelectromechanical system (MEMS) switch structure as claimed in claim 9, wherein said second MEMS actuator hot arm member comprises two spaced-apart portions, each of said two spaced-apart portions having a corresponding anchor pad for receiving a voltage.

11. The microelectromechanical system (MEMS) switch structure as claimed in claim 9, further comprising a second set of at least two additional tethers, each disposed over a portion of the second MEMS actuator elongated cold arm member and the second MEMS actuator elongated cold arm member.

12. The microelectromechanical system (MEMS) switch structure as claimed in claim 9, wherein said second MEMS actuator elongated hot arm member is set at an angle with respect to the second MEMS actuator elongated cold arm member.

13. The microelectromechanical system (MEMS) switch structure as claimed in claim 1, wherein said first support arm comprises a rigid base portion secured and a spring-like portion, further wherein said rigid base portion is operatively connected to the first MEMS actuator and said spring-like portion is connected to the first moveable conductive member.

14. The microelectromechanical system (MEMS) switch structure as claimed in claim 1, wherein said switch structure further comprises:

a third pair of spaced-apart, stationary electrical contacts each of said third pair of spaced-apart, stationary electrical contacts providing a third switch input;

a third moveable conductive member operatively mounted to the first support arm such that the third moveable conductive member is selectively deflected by activation of said first MEMS actuator on said third pair of spaced-apart, stationary electrical contacts to selectively switch between a third switch open position and a third switch closed position.

15. The microelectromechanical system (MEMS) switch structure as claimed in claim 14, wherein said switch structure further comprises:

a fourth pair of spaced-apart, stationary electrical contacts each of said fourth pair of spaced-apart, stationary electrical contacts providing a fourth switch input;

a fourth moveable conductive member operatively mounted to the second support arm such that the fourth moveable conductive member is selectively deflected by activation of said second MEMS actuator on said fourth pair of spaced-apart, stationary electrical contacts to selectively switch between a fourth switch open position and a fourth switch closed position.

* * * * *